US009465334B1

(12) United States Patent
Yagi et al.

(10) Patent No.: US 9,465,334 B1
(45) Date of Patent: Oct. 11, 2016

(54) FIXING DEVICE AND IMAGE FORMING APPARATUS

(71) Applicant: FUJI XEROX CO., LTD., Tokyo (JP)

(72) Inventors: Motoyuki Yagi, Kanagawa (JP); Yukihiro Ichiki, Kanagawa (JP); Yusuke Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/048,039

(22) Filed: Feb. 19, 2016

(30) Foreign Application Priority Data

Jul. 2, 2015 (JP) ..... 2015-133183

(51) Int. Cl.
*G03G 15/20* (2006.01)

(52) U.S. Cl.
CPC ..... *G03G 15/2028* (2013.01)

(58) Field of Classification Search
USPC ..... 399/107, 110, 121, 122, 320–323
See application file for complete search history.

(56) References Cited

U.S. PATENT DOCUMENTS 7,855,792 B2 * 12/2010 Nonaka ..... G03G 15/5012 358/1.13
8,005,399 B2 * 8/2011 Sahara ..... G03G 15/6579 399/122
8,041,277 B2 * 10/2011 Hashimoto ..... G03G 15/2028 399/322

FOREIGN PATENT DOCUMENTS

JP S59-128664 U 8/1984
JP H10-123773 A 5/1998

* cited by examiner

*Primary Examiner* — Hoan Tran
(74) *Attorney, Agent, or Firm* — Oliff PLC

(57) ABSTRACT

A fixing device includes a fixing part in which an image on a recording material is fixed, and a guiding member provided on an upstream side with respect to the fixing part in a direction of transport of the recording material. The guiding member guides the recording material toward the fixing part while, if the recording material that is being transported is skewed, reducing a speed of movement of a preceding part of a leading end of the recording material. The preceding part is ahead of any other part of the leading end of the recording material.

7 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2015-133183 filed Jul. 2, 2015.

BACKGROUND

Technical Field

The present invention relates to a fixing device and an image forming apparatus.

SUMMARY

According to an aspect of the invention, there is provided a fixing device including a fixing part in which an image on a recording material is fixed, and a guiding member provided on an upstream side with respect to the fixing part in a direction of transport of the recording material. The guiding member guides the recording material toward the fixing part while, if the recording material that is being transported is skewed, reducing a speed of movement of a preceding part of a leading end of the recording material. The preceding part is ahead of any other part of the leading end of the recording material.

BRIEF DESCRIPTION OF THE DRAWINGS

An exemplary embodiment of the present invention will be described in detail based on the following figures, wherein.

DETAILED DESCRIPTION

Figure 1:
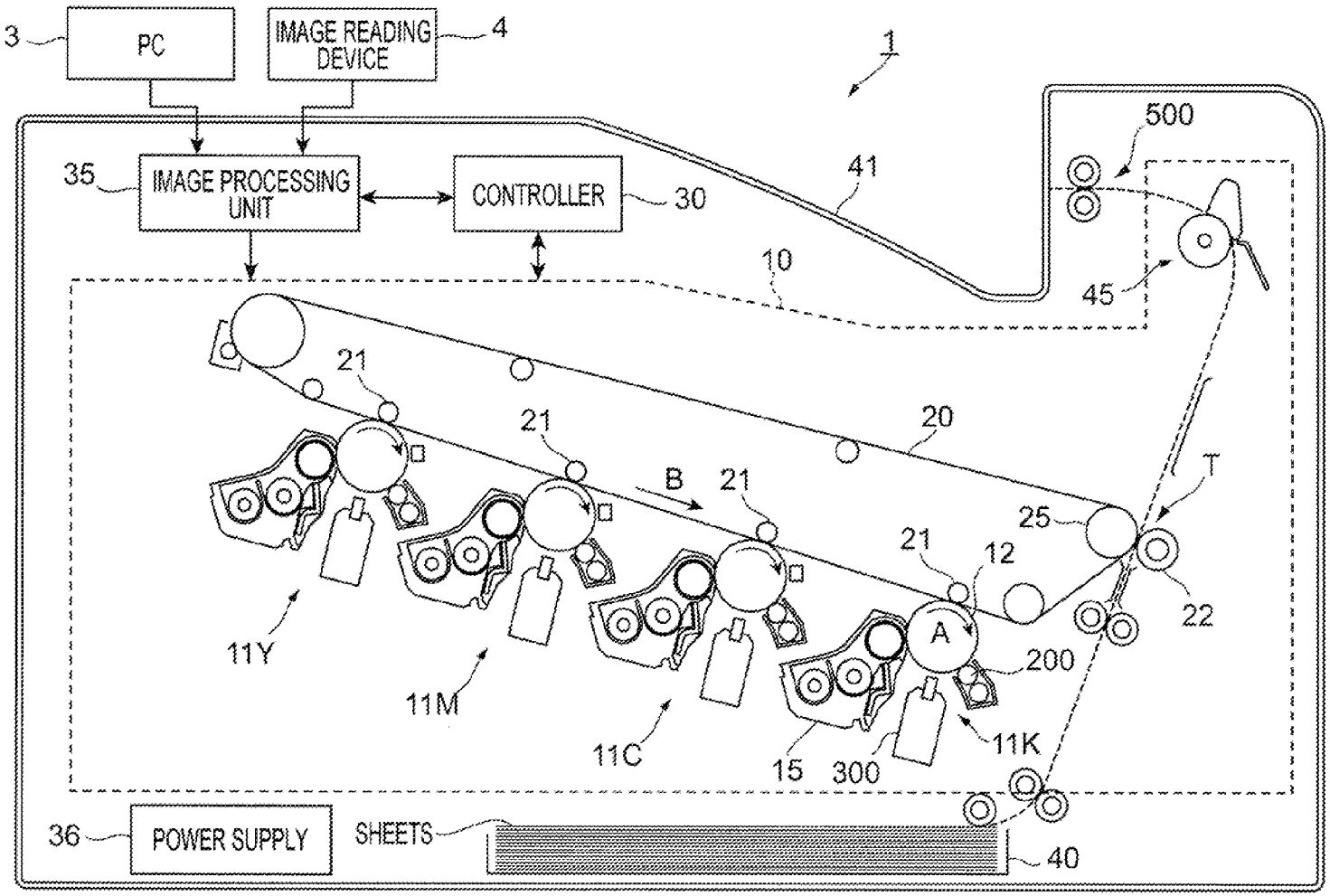
FIG. 1 illustrates an overall configuration of an image forming apparatus according to the exemplary embodiment.

FIG. 1 illustrates an overall configuration of an image forming apparatus 1 according to an exemplary embodiment of the present invention.

The image forming apparatus 1 is a so-called tandem-type color printer. The image forming apparatus 1 includes an image-forming-and-processing section 10 as an exemplary image forming device that forms an image on a sheet as an exemplary recording material. The image-forming-and-processing section 10 forms an image on a sheet on the basis of pieces of image data that are prepared for different colors.

The image forming apparatus 1 further includes a controller 30 that controls an overall operation of the image forming apparatus 1. The image forming apparatus 1 further includes an image processing unit 35.

The image processing unit 35 processes image data transmitted from a personal computer (PC) 3, an image reading device 4, or the like. The image forming apparatus 1 further includes a power supply 36 that supplies power to relevant elements.

The image-forming-and-processing section 10 includes four image forming units 11Y, 11M, 11C, and 11K (hereinafter also collectively referred to as "image forming units 11") that are arranged in parallel and at specific intervals.

The image forming units 11 all have the same configuration, except toners contained in respective developing devices 15 to be described later. The image forming units 11 form toner images in yellow (Y), magenta (M), cyan (C), and black (K), respectively.

The image forming units 11 each include a photoconductor drum 12, a charger 200 that charges the photoconductor drum 12, and a light-emitting-diode print head (LPH) 300 that exposes the photoconductor drum 12 to light.

The photoconductor drum 12 is charged by the charger 200 and is then exposed to light emitted from the LPH 300, whereby an electrostatic latent image is formed on the photoconductor drum 12.

The image forming unit 11 further includes a cleaner (not illustrated) that cleans the surface of the photoconductor drum 12, and the developing device 15 that develops the electrostatic latent image on the photoconductor drum 12 into a toner image.

The image-forming-and-processing section 10 further includes an intermediate transfer belt 20, first transfer rollers 21, a second transfer roller 22, and a fixing device 45. The toner images in the respective colors that are formed on the respective photoconductor drums 12 are sequentially transferred to the intermediate transfer belt 20 by the respective first transfer rollers 21 (in first transfer) in such a manner as to be superposed one on top of another. The set of toner images transferred to the intermediate transfer belt 20 is then transferred to a sheet by the second transfer roller 22 (in second transfer) and is fixed by the fixing device 45.

In the image forming apparatus 1, the image data transmitted from the PC 3 or the image reading device 4 is processed by the image processing unit 35 and is supplied to the image forming units 11 via an interface (not illustrated). Then, in the image forming unit 11K for black (K), for example, the photoconductor drum 12 is charged by the charger 200 while rotating in a direction of arrow A and is exposed to the light that is generated by the LPH 300 on the basis of the image data transmitted thereto from the image processing unit 35.

Thus, an electrostatic latent image for a black (K) image is formed on the photoconductor drum 12.

The electrostatic latent image on the photoconductor drum 12 is developed by the developing device 15, whereby a black (K) toner image is formed on the photoconductor drum 12.

Likewise, toner images in yellow (Y), magenta (M), and cyan (C) are formed by the respective image forming units 11Y, 11M, and 11C.

The toner images in the respective colors that have been formed by the image forming units 11 are sequentially electrostatically attracted, with the aid of the first transfer rollers 21, to the intermediate transfer belt 20 that is rotating in a direction of arrow B, whereby a toner image including the toner images in the respective colors that are superposed one on top of another is formed on the intermediate transfer belt 20.

With the rotation of the intermediate transfer belt 20, the toner image on the intermediate transfer belt 20 is transported to an area (second transfer part T) where the second transfer roller 22 is provided.

Synchronously with the reaching of the toner image to the second transfer part T, a sheet is fed from a sheet holding portion 40 to the second transfer part T.

In the second transfer part T, the second transfer roller 22 generates a transfer electric field, with which the toner image on the intermediate transfer belt 20 is electrostatically transferred to the sheet that has been fed thereto.

The sheet now having the toner image electrostatically transferred thereto is then released from the intermediate transfer belt 20 and is transported to the fixing device 45. The toner image on the sheet transported to the fixing device 45 undergoes a fixing process in which heat and pressure are applied to the sheet by the fixing device 45, whereby the toner image is fixed.

The sheet now having the fixed image is transported to a sheet stacking portion 41 by a pair of discharge rollers 500.

Figure 2:
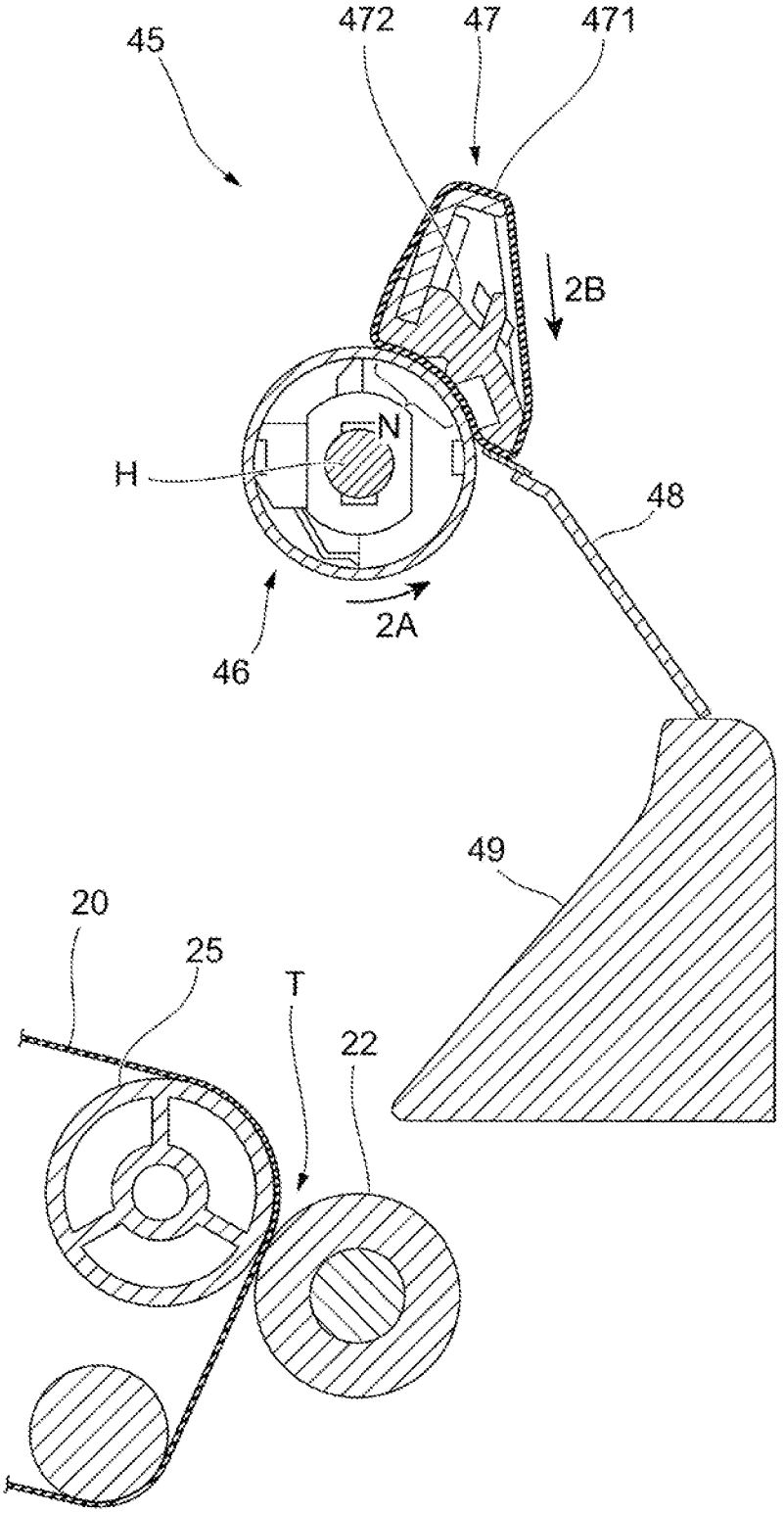
FIG. 2 illustrates a second transfer part and a fixing device.

FIG. 2 illustrates the second transfer part T and the fixing device 45.

The fixing device 45 includes a fixing roller 46 in which a heater H as a heat source is provided, and a pressing module 47 that is pressed against the fixing roller 46.

The part where the fixing roller 46 and the pressing module 47 are in contact with each other is defined as a fixing part (nip) N. In the fixing part N, the sheet is pressed and heated, so that the toner image on the sheet is fixed.

The fixing roller 46 is, for example, made of aluminum and has a cylindrical shape. The fixing roller 46 receives a rotational driving force from a motor (not illustrated) and thus rotates in a direction of arrow 2A illustrated in FIG. 2.

The pressing module 47 includes a belt member 471 having an endless shape. The belt member 471 is positioned in such a manner as to be in contact with the outer peripheral surface of the fixing roller 46. The belt member 471 receives the driving force from the fixing roller 46 and thus rotates in a direction of arrow 2B illustrated in FIG. 2.

The pressing module 47 further includes a pressing pad 472 provided on the inner side of the belt member 471 and that presses the fixing roller 46 with the belt member 471 interposed therebetween.

In the fixing device 45 according to the present exemplary embodiment, the pressing module 47 is not positioned vertically above the fixing roller 46. The pressing module 47 is positioned on the upper right side of the fixing roller 46.

Therefore, in the present exemplary embodiment, the sheet is fed to the fixing device 45 from the lower right side in FIG. 2 and is discharged from the fixing device 45 toward the upper left side in FIG. 2.

Now, the second transfer part T will be described.

At the second transfer part T, the second transfer roller 22 that transfers the set of toner images on the intermediate transfer belt 20 to the sheet is provided, as described above. Furthermore, a backup roller 25 is provided at the second transfer part T on the inner side of the intermediate transfer belt 20.

In the present exemplary embodiment, the second transfer roller 22 is pressed against the backup roller 25 with the intermediate transfer belt 20 interposed therebetween.

At the second transfer part T, the second transfer roller 22 is positioned on the lower right side of the backup roller 25. Therefore, a portion of the sheet that has passed through the second transfer part T advances toward the upper right side in FIG. 2.

Remind that, in the present exemplary embodiment, the sheet is fed to the fixing device 45 from the lower right side of the fixing device 45, as described above. However, the portion of the sheet that has passed through the second transfer part T moves toward the upper right side in FIG. 2. That is, the direction of upward movement of the sheet coming from the second transfer part T does not accord the direction in which the sheet is fed into the fixing device 45. Such a situation makes it difficult to feed the sheet into the fixing device 45.

Hence, in the present exemplary embodiment, a first guide member 48 as an exemplary guiding member that guides the sheet toward the fixing device 45 is provided on a locus of the sheet that moves upward from the second transfer part T. Thus, the sheet is guided toward the fixing device 45 with the aid of the first guide member 48.

In the present exemplary embodiment, a second guide member 49 that guides the sheet toward the first guide member 48 is also provided on the lower side in FIG. 2 (on a side closer to the second transfer part T) with respect to the first guide member 48.

In the present exemplary embodiment, if a less stiff sheet such as a thin sheet is transported, the sheet is guided by the second guide member 49 and then by the first guide member 48 and advances toward the fixing device 45.

On the other hand, if a highly stiff sheet such as a cardboard is transported, the sheet advances directly toward the first guide member 48 and is guided by the first guide member 48 toward the fixing device 45.

Figure 3:
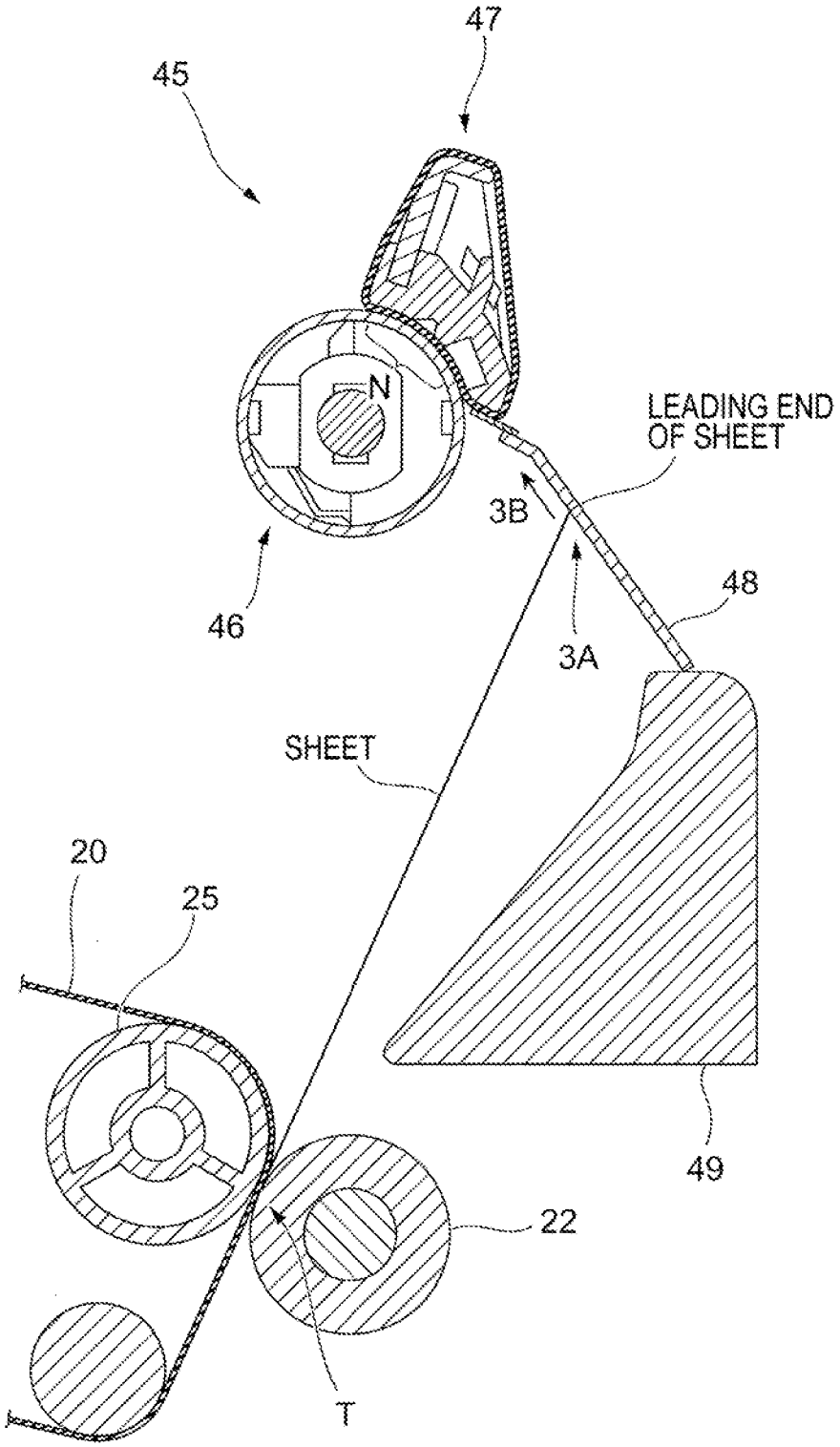
FIG. 3 illustrates a behavior of a sheet that is transported from the second transfer part toward the fixing device.

FIG. 3 illustrates such a behavior of the sheet that is transported from the second transfer part T toward the fixing device 45.

When a portion of the sheet that has come out of the second transfer part T advances toward the fixing device 45, the portion of the sheet is guided by the first guide member 48.

Specifically, a thin sheet or the like is guided by the second guide member 49 and then by the first guide member 48. However, a cardboard or the like is guided only by the first guide member 48, skipping the second guide member 49.

If the sheet directly advances toward the first guide member 48, the leading end of the sheet knocks against the first guide member 48 at a position indicated by arrow 3A in FIG. 3.

Then, in the present exemplary embodiment, the leading end of the sheet slides on the first guide member 48 toward the fixing device 45 as indicated by arrow 3B in FIG. 3 and eventually enters the fixing part N of the fixing device 45.

Figure 4:
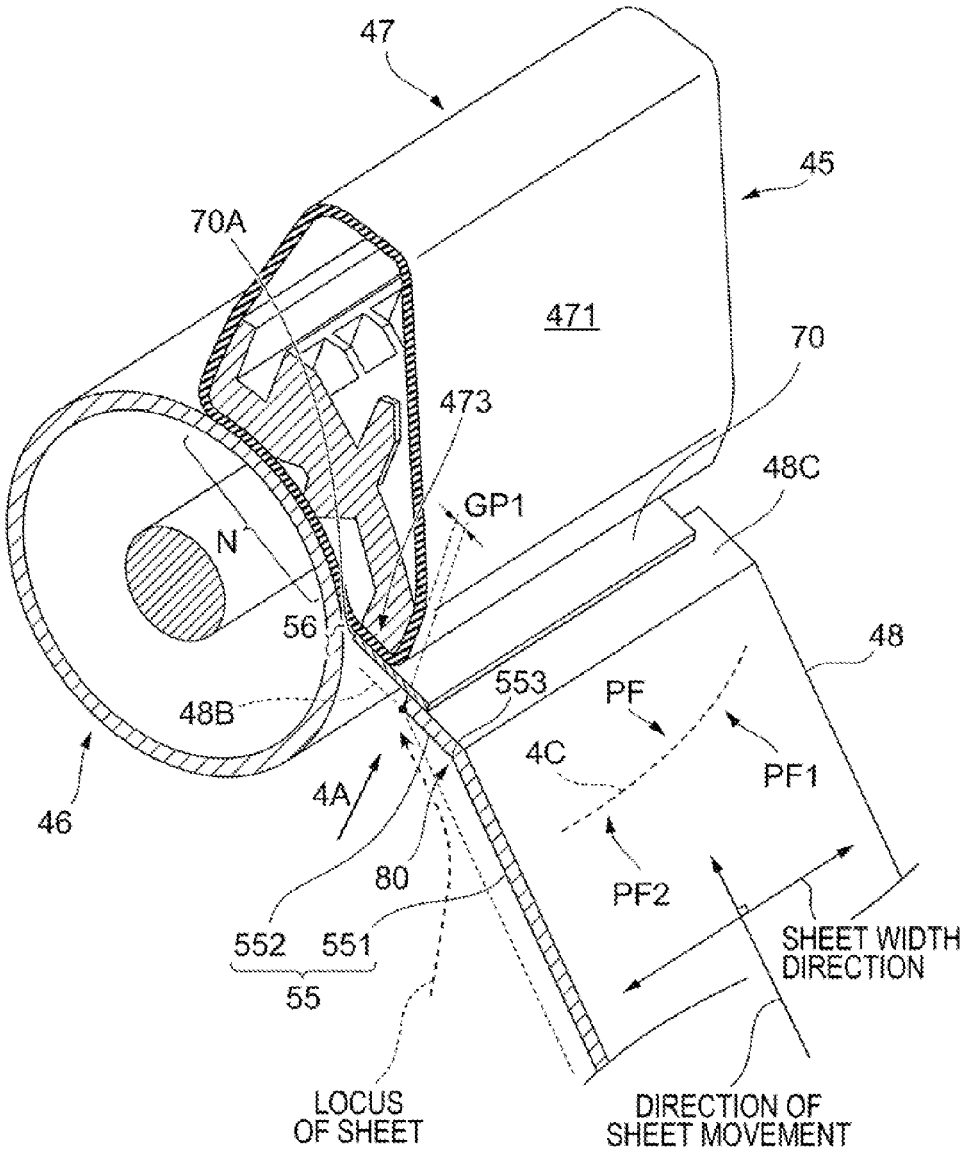
FIG. 4 is a perspective view of the fixing device and a first guide member.

FIG. 4 is a perspective view of the fixing device 45 and the first guide member 48.

The first guide member 48 has a plate-like shape and has a guiding surface 55 on one side (the lower side in FIG. 4) thereof. The sheet that is transported from the lower side is guided by the guiding surface 55. A downstream-side guiding portion 473 that also guides the sheet is provided on the downstream side with respect to (the guiding surface 55 of) the first guide member 48 in the direction of sheet transport.

In the present exemplary embodiment, after the sheet is guided by the downstream-side guiding portion 473, the sheet advances toward the fixing part N. The downstream-side guiding portion 473 is a portion of the outer peripheral surface of the belt member 471 included in the pressing module 47.

The downstream-side guiding portion 473 is positioned at an interval 56 from the guiding surface 55 of the first guide member 48.

More specifically, the downstream-side guiding portion 473 according to the present exemplary embodiment is not positioned on an extension 48B of the guiding surface 55 but is positioned above the extension 48B in FIG. 4, with the interval 56 interposed between the extension 48B and the downstream-side guiding portion 473.

In the present exemplary embodiment, since the sheet is transported from the lower side, the sheet is urged toward the upper side in FIG. 4, i.e., in a direction of arrow 4A (hereinafter referred to as "urging direction"). The downstream-side guiding portion 473 is positioned on the downstream side in the urging direction with respect to the extension 48B. Note that the downstream-side guiding portion 473 extends parallel to the extension 48B.

That is, in the urging direction, the extension 48B is defined on the upstream side, whereas the downstream-side guiding portion 473 is positioned on the downstream side.

In the present exemplary embodiment, an introducing member 70 (made of Mylar (a trademark)) is provided in a space produced by setting the interval 56 (hereinafter also referred to as "space 56").

The introducing member 70 is made of resin such as polyethylene terephthalate (PET) and has a plate-like shape. The introducing member 70 guides the sheet transported thereto by the first guide member 48 toward the downstream-side guiding portion 473 provided on the downstream side thereof, and introduces the sheet into the fixing part N. Furthermore, the introducing member 70 fills a part of the space 56 and thus reduces the level difference between the guiding surface 55 and the downstream-side guiding portion 473.

The introducing member 70 extends from a side where the first guide member 48 is provided toward the downstream-side guiding portion 473. A downstream end 70A of the introducing member 70 is a free end. That is, the introducing member 70 forms a cantilever.

The introducing member 70 is fixed to a back surface 48C (a surface opposite the guiding surface 55) of the first guide member 48 and extends from the position of the back surface 48C where the introducing member 70 is fixed toward the downstream-side guiding portion 473.

The introducing member 70 is in contact with the outer peripheral surface of the belt member 471.

In the present exemplary embodiment, the leading end of the sheet slides on the guiding surface 55 and reaches the downstream-side guiding portion 473. Since there is the space 56 between the guiding surface 55 and the downstream-side guiding portion 473, the leading end of the sheet tends to hop when reaching the space 56.

In such an event, the toner image (unfixed toner image) on the sheet may be distorted. Hence, in the present exemplary embodiment, the introducing member 70 is provided in the space 56, so that the hopping of the leading end of the sheet is suppressed.

The introducing member 70 also has a function of preventing the sheet from advancing in an unintended direction instead of advancing toward the fixing part N.

In the present exemplary embodiment, as illustrated in FIG. 4, the downstream end of the guiding surface 55 and the upstream end of the downstream-side guiding portion 473 are spaced apart from each other in the direction of sheet transport: that is, a gap GP1 is interposed between the two. In such a configuration, the sheet may be taken into the gap GP1 and advance in an unintended direction instead of advancing toward the fixing part N.

To prevent such a situation, the present exemplary embodiment employs the introducing member 70 extending from the side of the guiding surface 55 toward the downstream-side guiding portion 473 across the gap GP1.

Therefore, the sheet is prevented from being taken into the gap GP1 and from advancing in an unintended direction through the gap GP1 instead of advancing toward the fixing part N.

A broken line denoted by 4C in FIG. 4 represents a leading end PF of the sheet that is being guided by the guiding surface 55.

When the sheet is moving toward the fixing part N, the leading end PF of the sheet extends in the sheet width direction, which intersects the direction of sheet movement.

The sheet may be tilted while, for example, being transported. Accordingly, the leading end PF of the sheet may be tilted. More specifically, as illustrated in FIG. 4, the leading end PF is tilted with a widthwise part PF1 thereof preceding another widthwise part PF2 thereof.

The present exemplary embodiment employs a reducing portion 80 that reduces the speed of movement of the part PF1 (hereinafter referred to as "preceding part PF1") that precedes the part PF2. Hence, the speed of movement of the preceding part PF1 is reduced by the reducing portion 80.

Therefore, the other part PF2 (hereinafter referred to as "delayed part PF2") catches up the preceding part PF1. Consequently, the degree of tilt of the sheet is lowered.

In the present exemplary embodiment, the guiding surface 55 includes a first guiding surface 551 on the upstream side thereof and a second guiding surface 552 on the downstream side thereof. The first guiding surface 551 and the second guiding surface 552 meet each other at an obtuse angle.

When the preceding part PF1 goes over a connected part 553 between the first guiding surface 551 and the second guiding surface 552 (the part where the first guiding surface 551 and the second guiding surface 552 meet each other) and reaches the second guiding surface 552, the preceding part PF1 is caught by the second guiding surface 552.

Specifically, the preceding part FF1 slides on the first guiding surface 551 up to the connected part 553 and reaches the second guiding surface 552 earlier than the delayed part PF2. Then, the preceding part PF1 receives a larger drag from the second guiding surface 552 than a drag that has been applied to the preceding part PF1 while the preceding part PF1 has been sliding on the first guiding surface 551.

More specifically, the second guiding surface 552 does not lie on the extension of the first guiding surface 551 but is at an angle with respect to the extension of the first guiding surface 551. When the preceding part FF1 reaches the second guiding surface 552, the preceding part PF1 receives a drag from the second guiding surface 552.

Meanwhile, the delayed part PF2 is still sliding on the first guiding surface 551. In this state, the drag applied to the delayed part PF2 is smaller than the drag applied to the preceding part PF1.

Therefore, the speed of movement of the preceding part PF1 is reduced and becomes lower than the speed of movement of the delayed part PF2, and the delayed part PF2 catches up the preceding part FF1. Consequently, the degree of tilt of the leading end PF of the sheet is lowered.

If the degree of tilt of the leading end PF of the sheet is high, the preceding part PF1 reaches the fixing part N earlier than the delayed part PF2 and receives the rotational driving force from the fixing roller 46. Therefore, the speed of movement of the preceding part PF1 increases and becomes higher than the speed of movement of the delayed part PF2. The increase in the speed of movement of the preceding part PF1 is propagated toward the upstream side of the sheet in the direction of sheet transport. Therefore, at the second transfer part T, the speed of movement of the sheet becomes higher on the widthwise side of the preceding part PF1 than on the widthwise side of the delayed part PF2.

In such a case, the time over which the sheet keeps in contact with the second transfer roller 22 is shorter on the side of the preceding part PF1 than on the side of the delayed part PF2. Consequently, the image to be transferred may be distorted.

In the present exemplary embodiment, the occurrence of distortion of the unfixed toner image on the sheet that may be caused by possible contact between the unfixed toner image and the fixing roller 46 is suppressed.

Figure 5A:
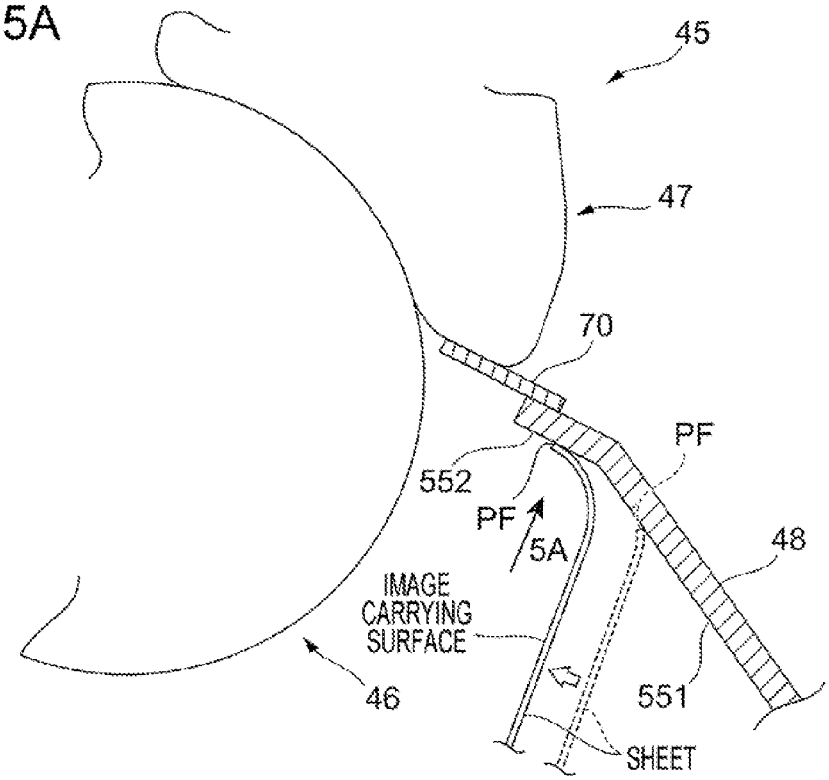
FIGS. 5A and 5B illustrate the behavior of a sheet that is advancing toward the fixing device in different configurations.
Figure 5B:
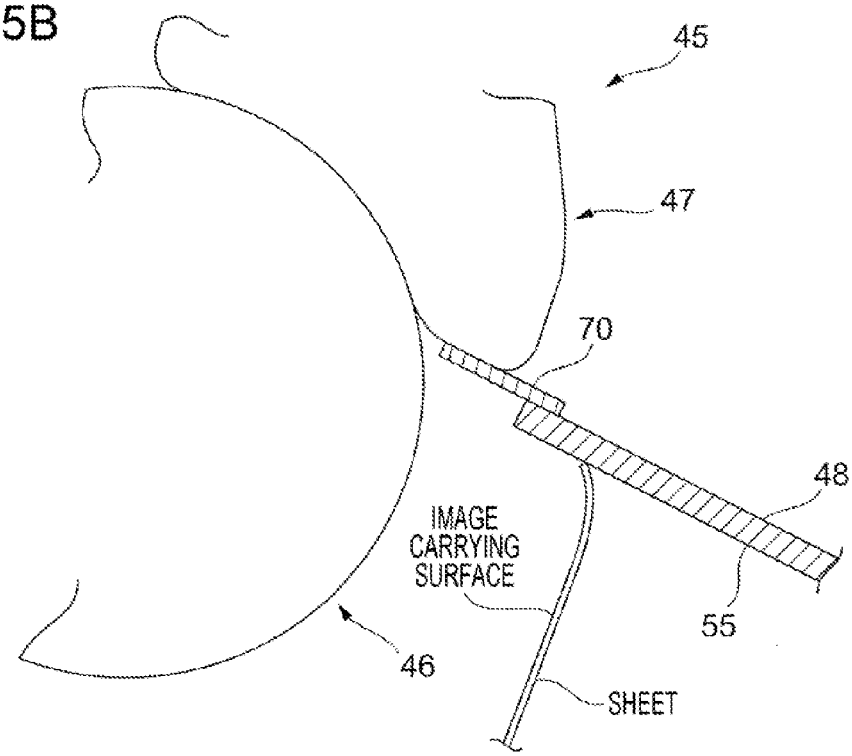

FIGS. 5A and 5B illustrate the behavior of the sheet that is advancing toward the fixing device 45 in different configurations.

In the present exemplary embodiment, as illustrated in FIG. 5A, when the leading end PF of the sheet that has been guided by the first guiding surface 551 reaches the second guiding surface 552, the leading end PF is pushed by the second guiding surface 552 (the leading end PF is pushed back toward the upstream side in the urging direction). Therefore, a portion of the sheet that is at the leading end is bent in such a manner as to be convex in a direction away from the fixing roller 46. The sheet thus bent then moves along the introducing member 70 and reaches the downstream-side guiding portion 473. The downstream-side guiding portion 473, which extends parallel to the extension 48B of the guiding surface 55, guides the sheet into the fixing part N with the sheet still being bent.

Thus, the surface of the sheet on which the toner image has been formed (i.e., the image carrying surface) is kept spaced apart from the fixing roller 46. Therefore, the occurrence of distortion of the image due to possible contact between the toner image and the fixing roller 46 is suppressed.

In contrast, if the guiding surface 55 extends linearly as illustrated in FIG. 5B, the sheet is less likely to be bent in such a manner as to be convex toward the direction away from the fixing roller 46. Therefore, the toner image on the sheet may be brought closer to the fixing roller 46 than in the case illustrated in FIG. 5A.

In such a case, since the toner image is more likely to come into contact with the fixing roller 46 than in the case illustrated in FIG. 5A. Consequently, the probability that the toner image may be distorted increases.

Modifications

Figure 6:
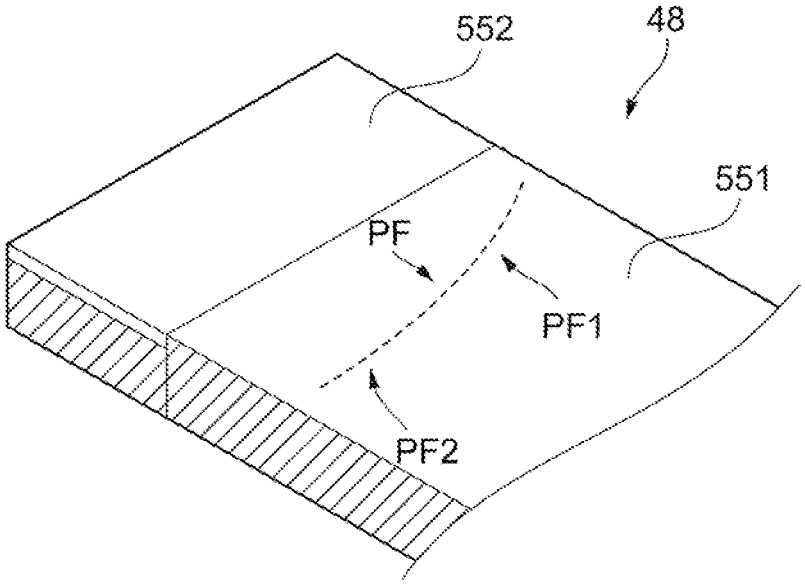
FIG. 6 illustrates an exemplary modification of the first guide member.

FIG. 6 is an enlarged view of an exemplary modification of the first guide member 48 that is seen in the direction of arrow 5A illustrated in FIG. 5A.

In this modification, the second guiding surface 552 is made of a rubber member having a higher frictional resistance than the first guiding surface 551. The second guiding surface 552 lies on the extension of the first guiding surface 551.

In such a configuration, if the leading end PF of the sheet is tilted, the preceding part PF1 slides on the first guiding surface 551 and reaches the second guiding surface 552 earlier than the delayed part PF2. Then, the preceding part PF1 receives a larger drag from the rubber member forming the second guiding surface 552 than a drag that has been applied to the preceding part PF1 while the preceding part PF1 has been sliding on the first guiding surface 551.

Meanwhile, the delayed part PF2 is still sliding on the first guiding surface 551. Therefore, in this state, the drag applied to the delayed part PF2 is smaller than the drag applied to the preceding part PF1.

Hence, the speed of movement of the preceding part PF1 becomes lower than the speed of movement of the delayed part PF2, and the delayed part PF2 catches up the preceding part PF1. Consequently, the degree of tilt the leading end PF of the sheet is lowered.

Figure 7:
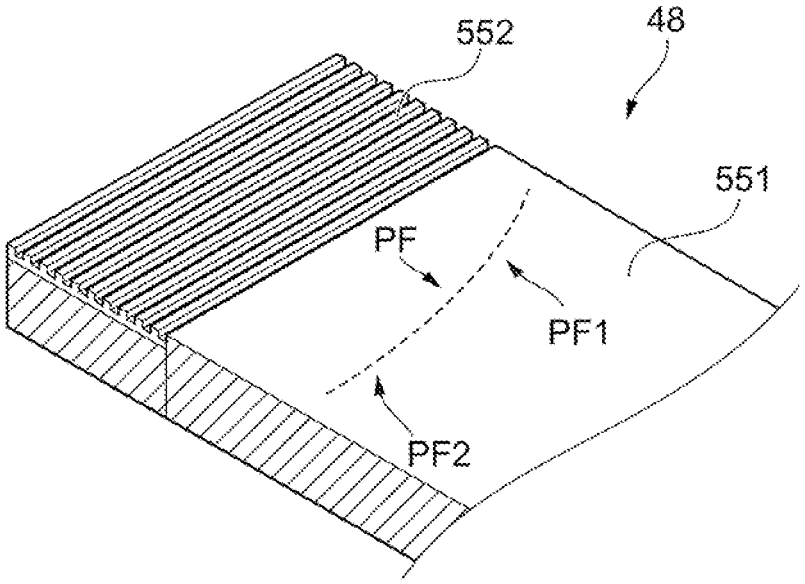
FIG. 7 illustrates another exemplary modification of the first guide member.

FIG. 7 is an enlarged view of another exemplary modification of the first guide member 48 that is seen in the direction of arrow 5A illustrated in FIG. 5A.

In this modification, the second guiding surface 552 has irregularities with grooves provided at predetermined intervals in the direction of sheet transport. The grooves each extend in the width direction of the first guide member 48, i.e., in a direction intersecting the direction of sheet transport. The second guiding surface 552 lies on the extension of the first guiding surface 551.

In such a configuration, if the leading end PF of the sheet is tilted, the preceding part PF1 slides on the first guiding surface 551 and reaches the second guiding surface 552 earlier than the delayed part PF2. Then, the preceding part PF1 is caught by the grooves provided in the second guiding surface 552. In this state, the preceding part PF1 receives a larger drag from the second guiding surface 552 having irregularities than a drag that has been applied to the preceding part PF1 while the preceding part PF1 has been sliding on the first guiding surface 551.

Meanwhile, the delayed part PF2 is still sliding on the first guiding surface 551. Therefore, in this state, the drag applied to the delayed part PF2 is smaller than the drag applied to the preceding part PF1.

Hence, the speed of movement of the preceding part PF1 becomes lower than the speed of movement of the delayed part PF2, and the delayed part PF2 catches up the preceding part PF1. Consequently, the degree of tilt of the leading end PF of the sheet is lowered.

Figure 8:
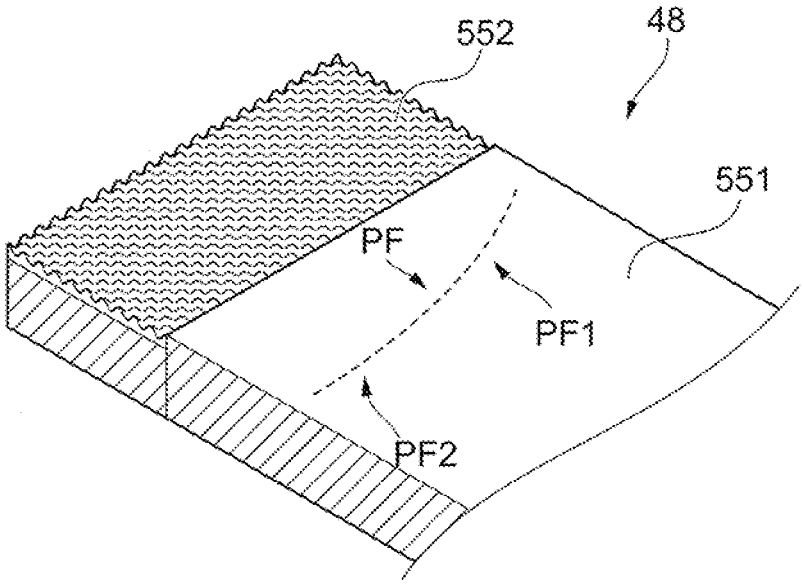
FIG. 8 illustrates a yet another exemplary modification of the first guide member.

FIG. 8 is an enlarged view of yet another exemplary modification of the first guide member 48 that is seen in the direction of arrow 5A illustrated in FIG. 5A.

In this modification, the second guiding surface 552 is embossed and has concavities provided at predetermined intervals in the direction of sheet transport and in the width direction of the first guide member 48. The second guiding surface 552 lies on the extension of the first guiding surface 551.

In such a configuration, if the leading end PF of the sheet is tilted, the preceding part PF1 slides on the first guiding surface 551 and reaches the second guiding surface 552 earlier than the delayed part PF2. Then, the preceding part PF1 is caught by the embossed surface forming the second guiding surface 552. In this state, the preceding part PF1 receives a larger drag from the concavities provided in the second guiding surface 552 than a drag that has been applied to the preceding part PF1 while the preceding part PF1 has been sliding on the first guiding surface 551.

Meanwhile, the delayed part PF2 is still sliding on the first guiding surface 551. Therefore, in this state, the drag applied to the delayed part PF2 is smaller than the drag applied to the preceding part PF1.

Hence, the speed of movement of the preceding part PF1 becomes lower than the speed of movement of the delayed part PF2, and the delayed part PF2 catches up the preceding part PF1. Consequently, the degree of tilt of the leading end PF of the sheet is lowered.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing part in which an image on a recording material is fixed; and a guiding member provided on an upstream side with respect to the fixing part in a direction of transport of the recording material, the guiding member guiding the recording material toward the fixing part while, if the recording material that is being transported is skewed, reducing a speed of movement of a preceding part of a leading end of the recording material, the preceding part being ahead of any other part of the leading end of the recording material.

2. The fixing device according to claim 1, wherein the guiding member reduces the speed of movement of the preceding part of the leading end of the recording material by applying a larger drag to the preceding part than to a delayed part of the leading end of the recording material, the delayed part being behind the leading part.

3. The fixing device according to claim 2, wherein the guiding member includes a first guiding surface that guides the recording material, and a second guiding surface connected to the first guiding surface and provided on a downstream side with respect to the first guiding surface in the direction of transport of the recording material, the second guiding surface being at an angle with respect to a direction in which the first guiding surface extends, and wherein, if the preceding part reaches the second guiding surface earlier than the delayed part, a larger drag is applied to the preceding part than to the delayed part and the speed of movement of the preceding part is reduced.

4. The fixing device according to claim 3, further comprising a downstream-side guiding portion provided on the downstream side with respect to the guiding member in the direction of transport of the recording material, the downstream-side guiding portion extending parallel to an extension of the second guiding surface and guiding the recording material received from the guiding member toward the fixing part.

5. The fixing device according to claim 2, wherein the guiding member includes a rubber member on a surface on which the recording material is guided, and wherein, if the preceding part reaches the rubber member earlier than the delayed part, a larger drag is applied to the preceding part than to the delayed part and the speed of movement of the preceding part is reduced.

6. The fixing device according to claim 2, wherein the guiding member has irregularities on a surface on which the recording material is guided, and wherein, if the preceding part reaches the irregularities earlier than the delayed part, a larger drag is applied to the preceding part than to the delayed part and the speed of movement of the preceding part is reduced.

7. An image forming apparatus comprising:

an image forming device that forms an image on a recording material;

a fixing part in which the image on the recording material is fixed; and a guiding member provided on an upstream side with respect to the fixing part in a direction of transport of the recording material, the guiding member guiding the recording material toward the fixing part while, if the recording material that is being transported is skewed, reducing a speed of movement of a preceding part of a leading end of the recording material, the preceding part being ahead of any other part of the leading end of the recording material.

* * * * *